US005684519A

United States Patent [19]

Matoba et al.

[11] Patent Number: 5,684,519

[45] Date of Patent: *Nov. 4, 1997

[54] INK JET HEAD WITH BUCKLING STRUCTURE BODY

[75] Inventors: Hirotsugu Matoba, Sakurai; Tetsuya Inui, Nara; Susumu Hirata, Ikoma-gun; Yorishige Ishii, Yamatotakada; Shingo Abe, Tenri; Kenji Ohta, Kitakatsuragi-gun, all of Japan

[73] Assignee: Sharp Kabushiki Kaisha, Osaka, Japan

[ * ] Notice: The term of this patent shall not extend beyond the expiration date of Pat. No. 5,666,141.

[21] Appl. No.: 414,327

[22] Filed: Mar. 31, 1995

[30] Foreign Application Priority Data

Apr. 19, 1994 [JP] Japan ..... 6-080057

[51] Int. Cl.[6] ..... B41J 2/04

[52] U.S. Cl. ..... 347/54; 347/20

[58] Field of Search ..... 347/54, 68, 70, 347/71, 20

[56] References Cited

U.S. PATENT DOCUMENTS

| | | | |
|---|---|---|---|
| 4,480,259 | 10/1984 | Kruger et al. | 347/54 |
| 4,539,575 | 9/1985 | Nilsson | 347/68 |
| 4,605,167 | 8/1986 | Maehara | 347/68 X |
| 4,998,120 | 3/1991 | Koto et al. | 347/70 |
| 5,302,976 | 4/1994 | Sugahara et al. | 347/69 |

FOREIGN PATENT DOCUMENTS

| | | | |
|---|---|---|---|
| 0 634273 A2 | 1/1995 | European Pat. Off. . | |
| 40 25619 A1 | 2/1992 | Germany . | |
| 57-87963 | 6/1982 | Japan . | |
| 63-57251A | 3/1988 | Japan . | |
| 63-297052 | 12/1988 | Japan . | |
| 2-30543 | 1/1990 | Japan . | |
| 2-30543A | 1/1990 | Japan . | |
| 4-52144 | 2/1992 | Japan | 347/68 |
| 4-1051A | 6/1992 | Japan . | |

*Primary Examiner*—Benjamin R. Fuller
*Assistant Examiner*—Charlene Dickens
*Attorney, Agent, or Firm*—Nixon & Vanderhye P.C.

[57] ABSTRACT

An ink jet of the present invention includes a nozzle plate having a nozzle orifice, a substrate having an opening communicating with the nozzle orifice, an ink discharge plate having a center portion positioned in the nozzle orifice of the nozzle plate and the opening, and both ends supported by being sandwiched between the nozzle plate and the substrate, the center portion being closer to the nozzle plate than the both ends, and a compressive member for applying a compressive force in the axis direction of the ink jet plate so that the center portion of the ink discharge plate is deformed towards the nozzle orifice by buckling. Because of this structure, the ink discharge plate is always buckled towards the nozzle orifice, and forms an ink droplet without erroneous operation.

9 Claims, 7 Drawing Sheets

INK JET HEAD WITH BUCKLING STRUCTURE BODY

BACKGROUND OF THE INVENTION

1. Field of the Invention

The present invention relates to a structure of an ink jet head used in an ink jet printer or the like.

2. Description of the Background Art

An ink jet method of recording by discharging and spraying out a recording liquid is conventionally known. This method offers various advantages such as high speed printing with low noise, reduction of the device in size, and facilitation of color recording. Such an ink jet recording method carries out recording using an ink jet record head according to various droplet discharging systems. For example, according to a technique disclosed in Japanese Patent Laying-Open No. 63-297052 and Japanese Patent Laying-Open No. 2-30543, ink discharge means of a plate shape is provided opposing a nozzle orifice, a compressive force is generated by compression means with respect to the ink discharge means, and the ink discharge means is deformed to discharge ink. Referring to FIGS. 14 and 15, an ink jet head disclosed in Japanese Patent Laying-Open No. 2-30543 will be described.

Referring to FIG. 14, a structure of an ink jet printer in which the ink jet head is used will be described. A recording sheet of paper 110 is wound around a platen 111, and pressed by feed rollers 112 and 113. An ink jet head 116 is mounted on a carriage 115 guided by guide axes 114 and 117 and capable of moving in a direction parallel to platen 111.

Ink jet head 116 has a plurality of nozzle orifices independently capable of controlling discharge of ink droplets. Ink jet head 116 is operated in the axis direction of platen 111, and selectively discharges ink droplets from the nozzle orifices to form an ink image on recording sheet of paper 110. Recording sheet of paper 110 is fed in a sub operation direction orthogonal to an operation direction of ink jet head 116 by rotation of platen 111, and feed rollers 112 and 113, and printing on recording sheet of paper 110 is carried out.

Referring to FIG. 15, a structure of the ink jet head disclosed in Japanese Patent Laying-Open No. 2-30543 will be described. Between a nozzle plate 121 having a nozzle orifice 120 formed therein and a frame 127, spacers 122 and 133 are tightened by screws 128 and 130. The frame 127 and nozzle plate 121 form an ink chamber 132 filled with recording ink 131. On one surface of spacer 122 and 133, formed are pattern electrodes 134 and 135, to which electric signal lines 124 and 125 are connected. A pressure generating member 140 is in a fixed beam structure, having both ends fixed by spacers 122 and 133.

Operation of the ink jet head structured as described above will now be described. When a voltage is applied to electric signal lines 124 and 125, current flows in the longitudinal direction of pressure generating member 140, resulting in the temperature rise of pressure generating member 140. Due to the temperature rise of pressure generating member 140, thermal distortion is generated in pressure generating member 140. Since pressure generating member 140 have both ends fixed, however, pressure generating member 140 is deformed towards nozzle plate 121. As a result, recording ink 130 in the vicinity of nozzle orifice 120 can be sprayed out from nozzle orifice 120 as an ink droplet.

However, in the ink jet head as structured above, pressure generating member 140 does not necessarily exhibit deformation caused by thermal distortion towards nozzle plate 121.

This is because only a surface of pressure generating member 140 facing nozzle plate 121 is supported by spacers 122 and 133. More specifically, in the interior of pressure generating member 140, the side opposing nozzle plate 121 has a larger degree of freedom than the side of nozzle plate 121. As a result, a bending moment generated in a portion of pressure generating member 140 supported by spacers 122 and 133 acts to mechanically displace pressure generating member 140 to the side opposing nozzle plate 121. In other words, pressure generating member 140 is displaced to the side opposing nozzle plate 121, and ink jet head 116 cannot spray out ink droplets, resulting in erroneous operation of ink jet head 116.

SUMMARY OF THE INVENTION

One object of the present invention is to provide an ink jet head which controls a direction of deformation of a buckling structure body with a simple configuration, and which does not operate erroneously.

Another object of the present invention is to provide an ink jet head which can obtain a large discharge power while maintaining a small device size.

Still another object of the present invention is to provide an ink jet head superior in a high response rate, and capable of sufficiently adapting to high speed printing.

In order to achieve the above objects, an ink jet head of the present invention applying pressure to an ink liquid filled in the interior thereof for discharging an ink droplet outwards from the interior includes a nozzle plate having a nozzle orifice, a vessel having an ink flow path communicating with the nozzle orifice, a buckling structure body having a center portion located between the nozzle orifice of the nozzle plate and the ink flow path and both ends supported by being sandwiched between the nozzle plate and the vessel, the center portion being closer to the nozzle plate than the both ends, and a compressive member for applying a compressive force in the axis direction of the buckling structure body so that the center portion of the buckling structure body is deformed by buckling towards the nozzle orifice.

According to this structure, the both ends of the buckling structure body are supported by being sandwiched between the nozzle plate and the vessel, and the center portion of the buckling structure body is located closer to the nozzle plate than the both ends. When a compressive force is applied in the axis direction of the buckling structure body by the compressive member, a bending moment always acts to deform the buckling structure body towards the nozzle plate because of offset of the axis direction towards the nozzle plate at the center portion. As a result, ink droplets can be reliably discharged, and erroneous operation of the ink jet head can be prevented.

Preferably, a power source device capable of applying a voltage to the buckling structure body is used as the compressive member.

According to this structure, application of a voltage to the buckling structure body causes current to flow in the axis direction of the buckling structure body, resulting in resistance heating. The buckling structure body tries to induce thermal expansion as a result of being heated due to the resistance heating. However, a compressive force is generated in the interior of the buckling structure body since both ends of the buckling structure body are fixed. It is possible to buckle the buckling structure body due to the compressive force.

Preferably, the buckling structure body is formed of a metal material, more preferably of nickel or titanium.

By using such a metal material, a product of $E \times \alpha^2$ of Young's modulus E and a coefficient of linear expansion $\alpha$ of the buckling structure body becomes larger, resulting in larger buckling deformation of the buckling structure body and a larger discharge power.

Preferably, the buckling structure body is a rectangle in its cross sectional shape.

Because of a rectangular cross sectional shape of the buckling structure body, buckling deformation does not occur until the compressive force exceeds the buckling load, and buckling deformation suddenly occurs when the compressive force exceeds the buckling load. Therefore, a larger discharge power can be obtained.

Preferably, an angle made by a connecting portion connecting the center portion and the both ends of the buckling structure body and the center portion is an obtuse angle.

Because of an obtuse angle made by the connecting portion and the center portion, the buckling structure body is controlled to be reliably buckled towards the nozzle plate.

Preferably, the length of the center portion of the buckling structure body in the longitudinal direction is ½ or more of the entire length of the buckling structure body in the longitudinal direction.

By setting the length of the center portion as described above, the center portion can be reliably buckled.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

The embodiment of the present invention will be described hereinafter with reference to the drawings.

Figure 1:
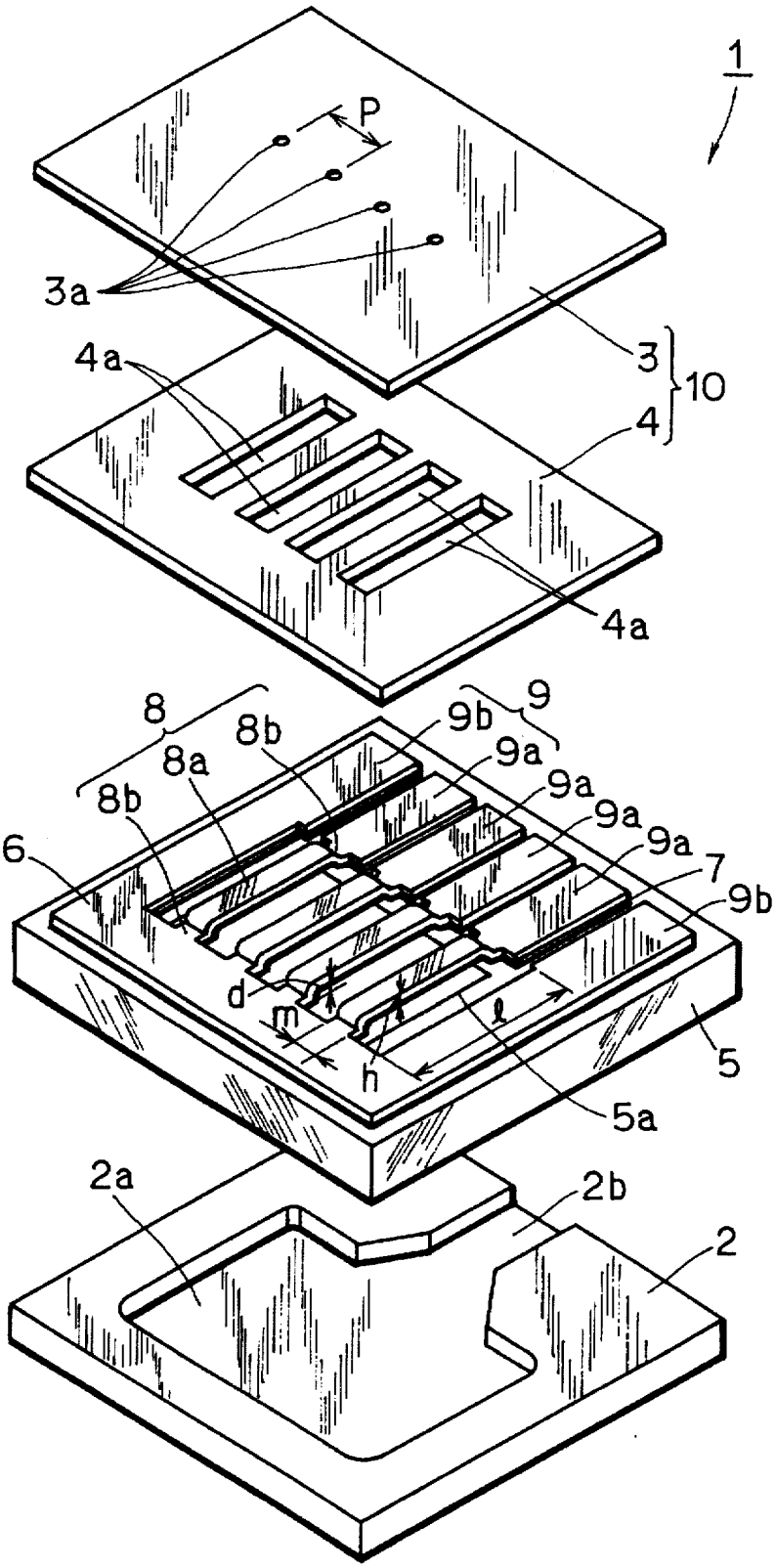
FIG. 1 is an exploded perspective view showing a structure of an ink jet head according to the embodiment of the present invention.
Figure 2:
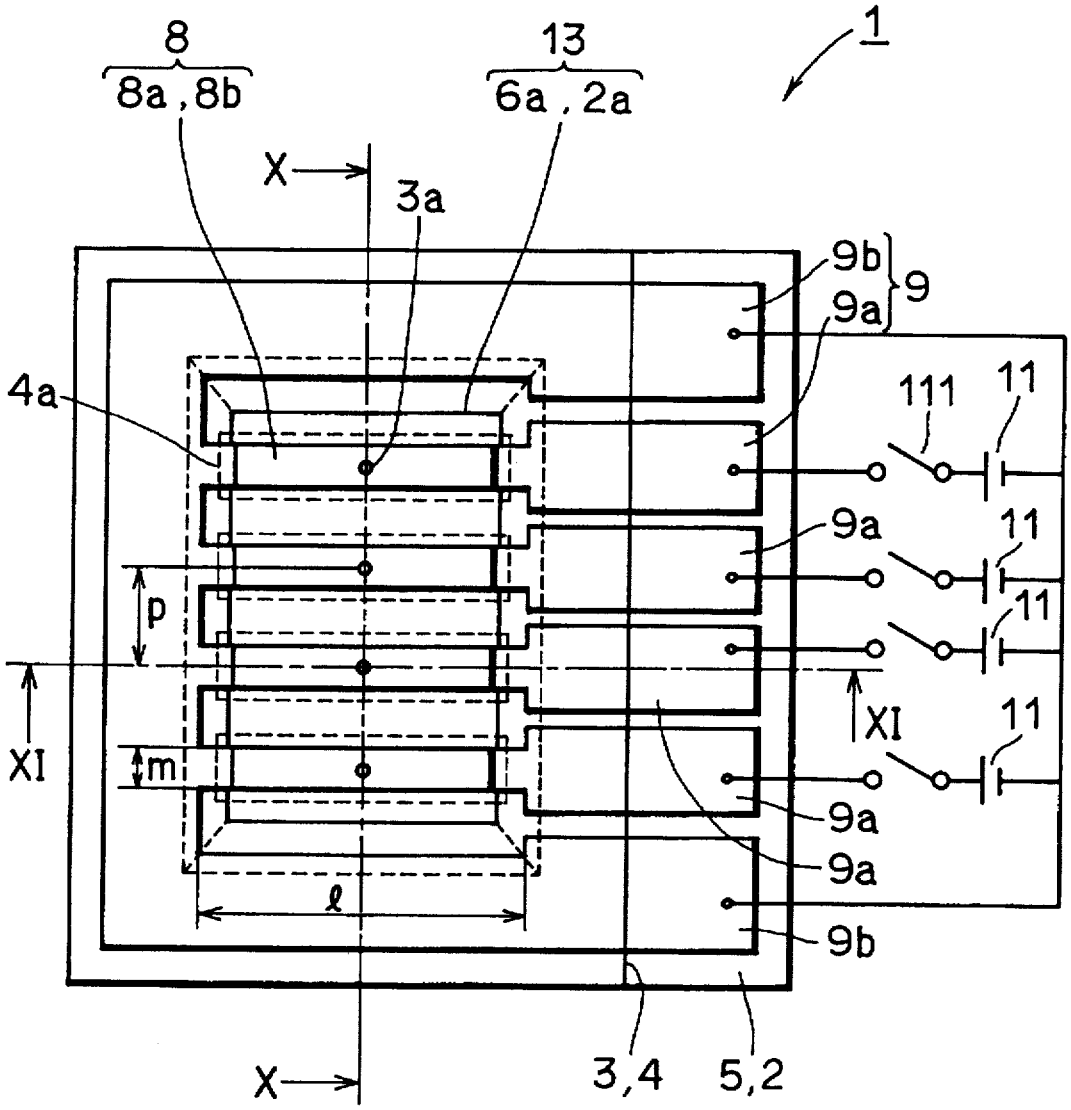
FIG. 2 is a plan view showing the structure of the ink jet head according to the embodiment of the present invention.

Referring to FIGS. 1 and 2, an ink jet head 1 according to the embodiment includes a nozzle portion 10, a casing 5 on which an ink discharge plate forming layer 6 is formed, and an ink cover 2.

Nozzle portion 10 is formed of a nozzle plate 3 and a spacer 4. Nozzle plate 3 has a thickness of approximately 0.2 mm, and is formed of a glass material. Nozzle plate 3 includes nozzle orifices 3*a* piercing the same. Nozzle orifice 3*a* is formed in a conical or funnel-like configuration having a diameter of 30 μm on the upper side of the nozzle plate, and a diameter of 50 μm on the lower side of the nozzle plate. In this embodiment, four nozzle orifices 3*a* are arranged in a predetermined direction with an interval (p) of 125 μm. Nozzle orifice 3*a* is positioned in nozzle plate 3 opposing a center portion 8*a* of an ink discharge plate 8, to be described later.

Spacer 4 is formed of a stainless steel plate having a thickness of 20 μm. Spacer 4 is positioned under nozzle plate 3. In spacer 4, four openings 4*a* of a predetermined shape are provided. Opening 4*a* has a size enough to receive ink discharge plate 8 to be described later, and is positioned directly under nozzle orifice 3*a*. Opening 4*a* is formed by a punching work, for example.

Casing 5 is formed of a single crystalline silicon substrate having a main surface of a plane orientation of (100). In casing 5, an opening 5*a* is provided piercing casing 5. Opening 5*a* is inclined so that the sidewall gradually extends from the side of spacer 4 to the side of ink cover 2. On the surface of casing 5 towards spacer 4, ink discharge plate forming layer 6 formed of an Ni thin film is provided with an insulative member 7 formed of PSG (Phospho Silicate Glass) interposed therebetween. Ink discharge plate forming layer 6 includes an ink discharge plate 8 and a compressive member 9.

Ink discharge plate 8 has a length l of 300–600 μm, a width m of 60 μm, and a thickness h of 6 μm. A center portion 8*a* of ink discharge plate 8 is arranged corresponding to nozzle orifice 3*a*. Center portion 8*a* of ink discharge plate 8 has a step d (an amount of projection of approximately 1 μm) so as to approach towards nozzle orifice 3*a* by a small amount more than both ends 8*b*.

Ink discharge plate 8 is in a rectangular shape in cross section of both center portion 8*a* and both ends 8*b* so that a buckling phenomenon easily occurs. Both ends 8*b* of ink discharge plate 8 are fixed to ink discharge plate forming layer 6.

Compressive member 9 includes all the region of ink discharge plate forming layer 6 excluding the region of ink discharge plate 8. Compressive member 9 is formed of a pilot electrode 9*a* and a common electrode 9*b* for connection to an external power supply device. Current flows to pilot electrode 9*a* from a power source 11 via a switch 111.

Ink cover 2 has a recess portion 2*a* having a predetermined depth and an ink feed inlet 2*b* communicating with one side of recess portion 2*a* formed on the surface towards casing 5.

Figure 3:
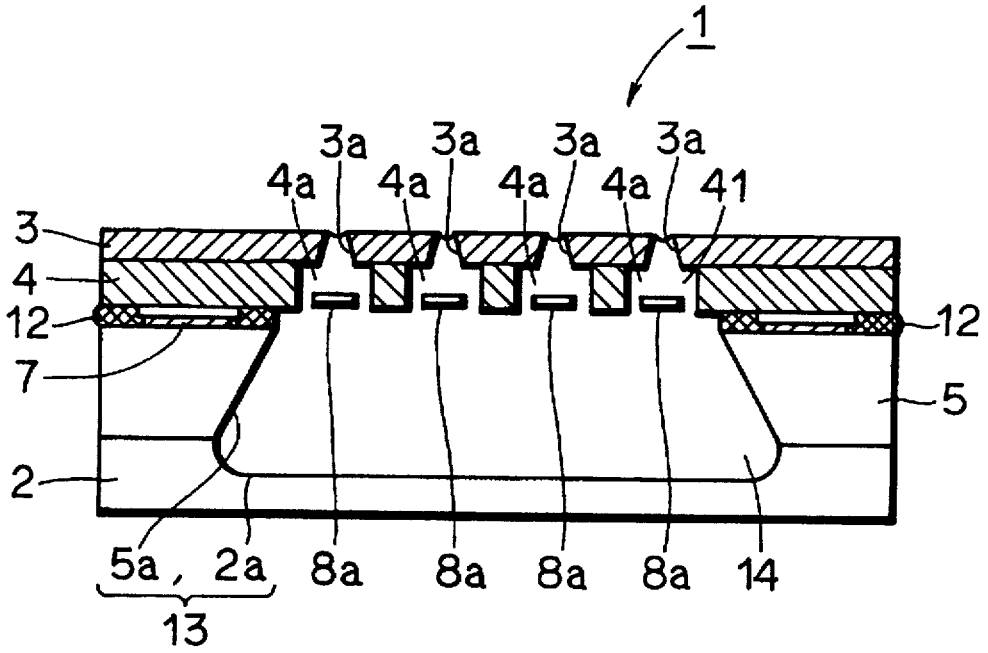
FIG. 3 is a schematic sectional view taken along the line X—X of FIG. 2.
Figure 4:
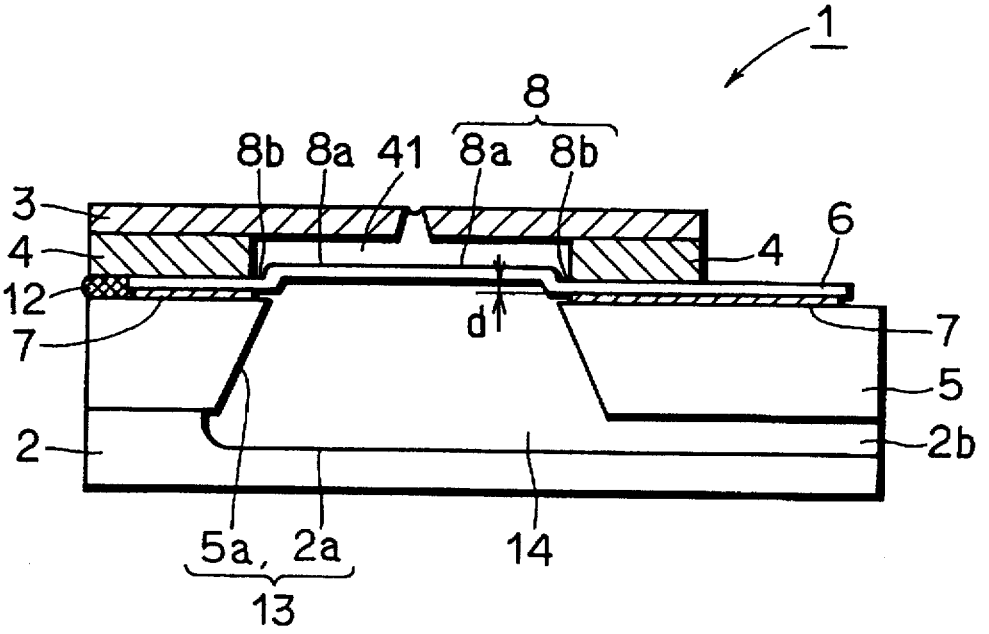
FIG. 4 is a schematic sectional view taken along the line XI—XI of FIG. 2.

As shown in FIGS. 3 and 4, nozzle plate 3 is bonded by a non-conductive epoxy adhesive agent 12 to the upper surface of casing 5 with spacer 4 interposed therebetween, so that opening 4*a* of spacer 4 and ink discharge plate 8 are positioned directly under nozzle orifice 3*a*. As a result, opening 4*a* forms a cavity for ink discharge plate 8 to apply pressure to ink 14, that is, a so-called pressure chamber 41.

Ink cover 2 is fixedly bonded to the lower surface of casing 5 by epoxy adhesive agent 12. Here, an ink chamber 13 is formed by opening 5*a* provided in casing 5 and recess portion 2a provided in ink cover 2. Ink feed inlet 2b is complete so as to communicate with ink chamber 13 to connect to the outside world. Ink 14 is supplied to ink chamber 13 from an external ink tank layer (not shown) through ink feed inlet 2b.

A continuous cavity or vessel having an ink flow path is formed by ink chamber 13 and/or pressure chamber 41 by arrangement of nozzle portion 10, ink discharge plate forming layer 6, and ink cover 2 in alignment. The ink flow path communicates with the nozzle orifice of the nozzle portion.

Description will now be given of operation of ink jet head 1 with reference to FIGS. 5 and 6.

Figure 5:
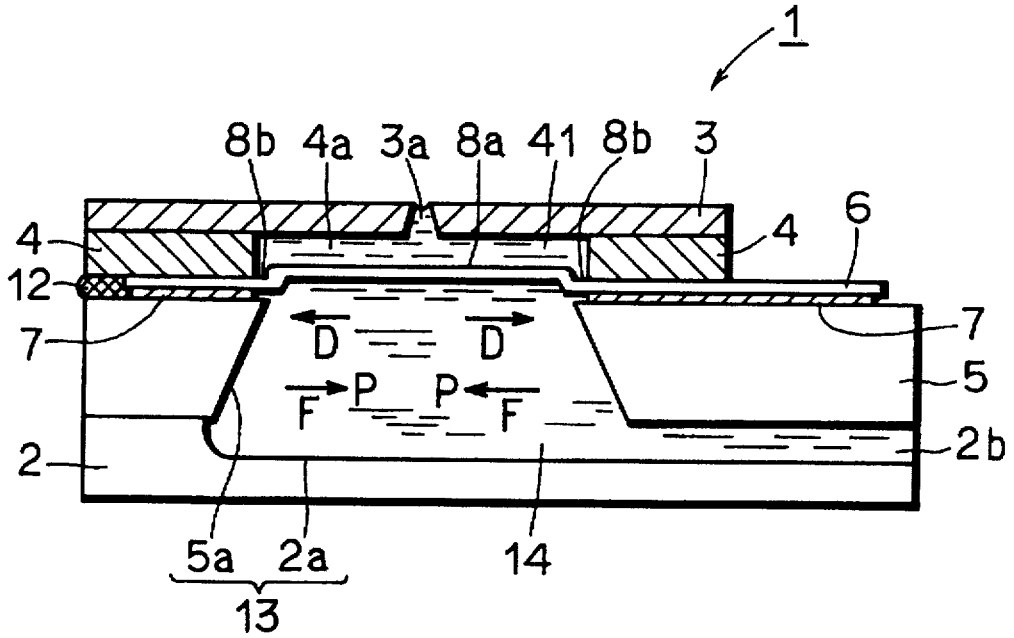
FIG. 5 is a first sectional view showing an operative state of the ink jet head according to the embodiment of the present invention.

Referring to FIG. 5, ink 14 is supplied from an external ink tank layer (not shown) through ink feed inlet 2b to fill ink chamber 13 and pressure chamber 41 with ink 14. Then, current is caused to flow in compressive member 9 (pilot electrode 9a and common electrode 9b) by switch 111 shown in FIG. 2. As a result, current flows in ink discharge plate 8. Heated by resistance heating, ink discharge plate 8 tries to induce thermal expansion in the longitudinal direction (in the direction indicated by an arrow D in the figure). Since ink discharge plate 8 has both ends 8b fixed, however, ink discharge plate 8 cannot be expanded in the longitudinal direction. A compressive force P is generated in the direction indicated by an arrow F in the figure as a repulsive force.

Figure 6:
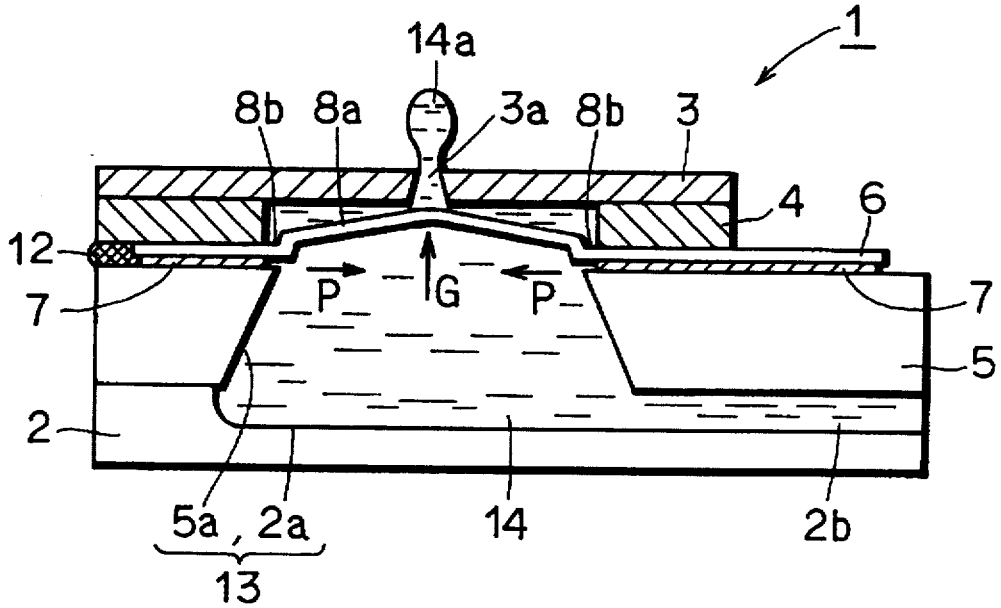
FIG. 6 is a second sectional view showing the operative state of the ink jet head according to the embodiment of the present invention.

Referring to FIG. 6, ink discharge plate 8 is shaped so that center portion 8a projects towards nozzle plate 3 more than both ends 8b. Therefore, a position where the compressive force P acts at center portion 8a is offset by the projection, a bending moment acts to deform ink discharge plate 8 towards nozzle plate 3. Although having a step, ink discharge plate 8 is rectangular in its cross section so as to establish buckling deformation as a whole. Therefore, ink discharge plate 8 does not establish deformation until the compressive force P exceeds the buckling load. When ink discharge plate 8 is heated, and the compressive force P exceeds the buckling load, ink discharge plate 8 is suddenly deformed.

The deformation always occurs in the direction towards nozzle orifice 3a (in the direction indicated by an arrow G in the figure) because of the bending moment. As described above, due to the buckling deformation of ink discharge plate 8, pressure is applied to ink 14 filling pressure chamber 41, and an ink droplet 14a can be sprayed outside. Then, deformation of ink discharge plate 8 is stopped by abutment of center portion 8a of ink discharge plate 8 on nozzle orifice 3a, whereby discharge of ink is complete.

Since deformation of ink discharge plate 8 is stopped by abutment of ink discharge plate 8 on nozzle orifice 3a as described above, the amount of deformation of ink discharge plate 8 is limited to a prescribed amount. Therefore, it is possible to always keep the amount of ink droplet 14a constant. Although ink discharge plate 8 is abutted on nozzle orifice 3a to limit the deformation of ink discharge plate 8 in this embodiment, the present invention is not limited thereto. Alternatively, ink discharge plate 8 may be abutted on nozzle plate 3, or a member for suppressing deformation of ink discharge plate 8 may be separately provided.

It should be noted that Ni is used as a material of ink discharge plate 8 in this embodiment. This is because Ni has a large product of $E \times \alpha^2$ of Young's modulus E and a coefficient of linear expansion $\alpha$, resulting in large energy applied to ink 14 by buckling deformation and a high initial speed upon discharge of ink. Further, ink discharge plate 8 is likely to expand due to current flow when Ni is used as a material thereof. Ni is superior in workability in that it can be worked by a plating method or the like. It should be noted that the similar effects can be obtained by using a metal material of Ti or the like instead of Ni.

A method of manufacturing ink discharge plate 8 and compressive member 9 of ink jet head 1 in this embodiment will be described hereinafter with reference to FIGS. 7 to 12.

Figure 7:
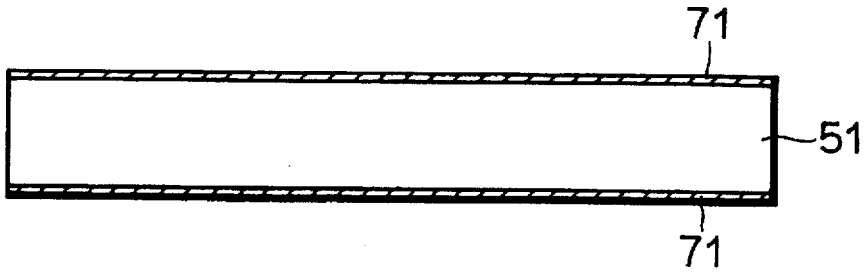
FIGS. 7–12 are schematic sectional views showing the steps in order of a method of manufacturing a casing of the ink jet head according to the embodiment of the present invention.

Referring to FIG. 7, a substrate 51, for manufacturing a casing, of single crystalline silicon having a main surface of a plane orientation of (100) is first prepared. A silicon oxide layer ($SiO_2$) 71 (PSG layer) containing phosphorus (P) by 6–8% is formed by an LPCVD device to a thickness of 2 μm, for example, at both faces of substrate 51.

Figure 8:
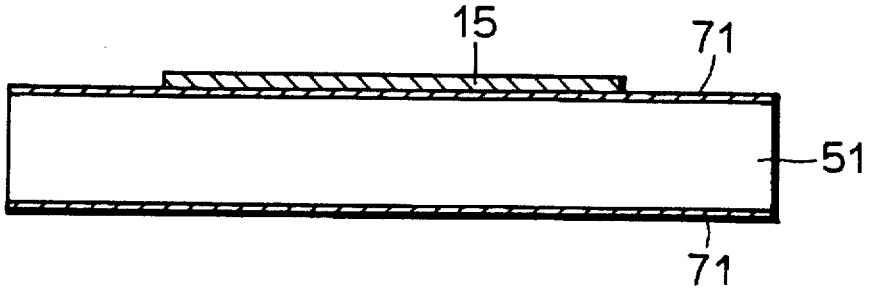

Referring to FIG. 8, an aluminum (Al) layer 15 having a thickness of 1 μm is formed on PSG layer 71 on the main surface of substrate 51 using a sputtering device or vacuum evaporation device. Then, aluminum layer (Al) 15 is patterned by etching so as to be left in a portion corresponding to center portion 8a of ink discharge plate 8.

Figure 9:
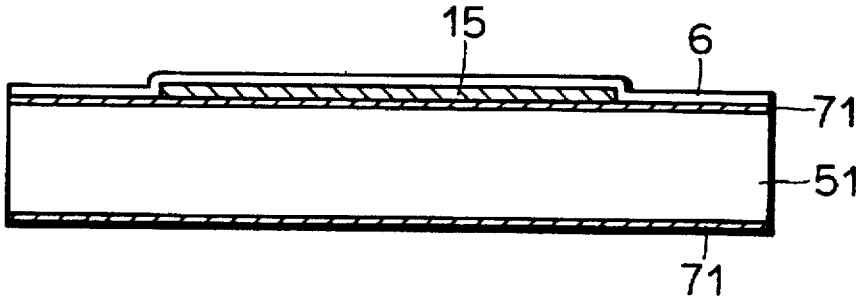

Referring to FIG. 9, ink discharge plate forming layer 6 of nickel (Ni) is formed on the surface of substrate 51 to have a thickness of 6 μm by electroplating. In this electroplating step, a nickel film is formed on the surface of substrate 51 with a thickness of 1000 Å, for example, by a sputtering device or vacuum evaporation device. Using this nickel film as a conductive layer, nickel is plated on the conductive layer in a sulfamic acid Ni plating liquid, for example.

Figure 10:
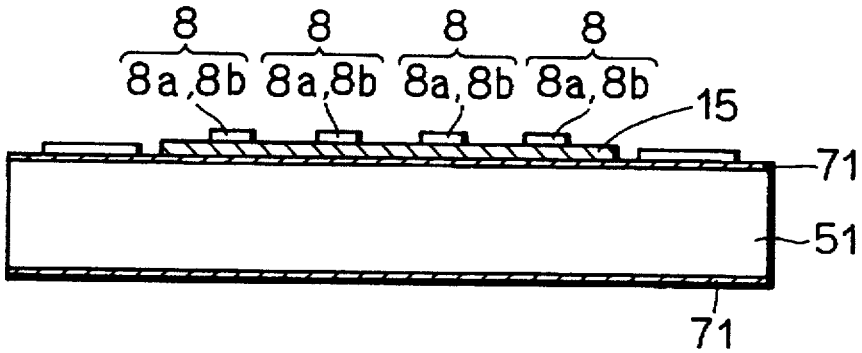

Referring to FIG. 10, ink discharge plate forming layer 6 is etched to be patterned into a desired shape. As a result, ink discharge plate 8 and compressive member 9 (not shown) of a nickel layer are formed. In this ink discharge plate 8, center portion 8a projects more than both ends 8b by the thickness of aluminum layer 15.

Therefore, the size of a step according to a manufacturing method of this embodiment is preferably in a range of 100 Å–10 μm when the step is formed using aluminum layer 15, or alternatively using a resist layer.

Figure 13:
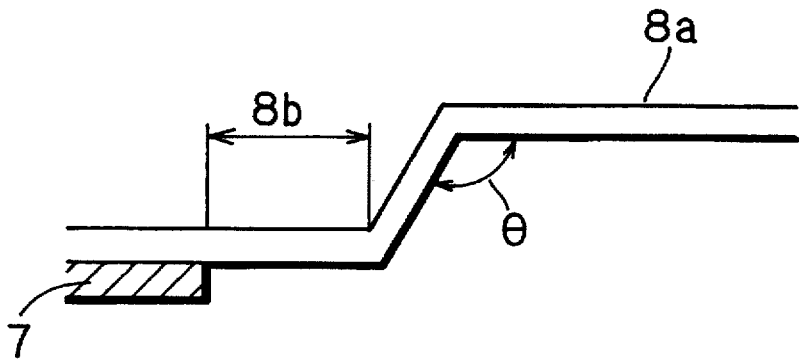
FIG. 13 is a partial sectional view showing a shape of a buckling structure body of the ink jet head according to the embodiment of the present invention.
Figure 14:
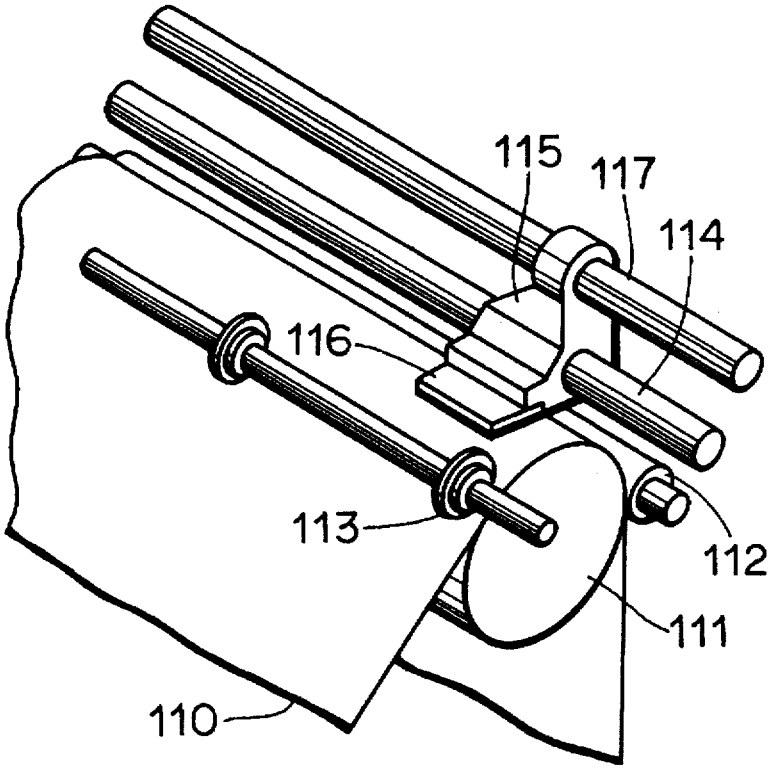
FIG. 14 PRIOR ART
FIG. 14 is a perspective view of an ink head printer disclosed in Japanese Patent Laying-Open No. 2-30543.
Figure 15:
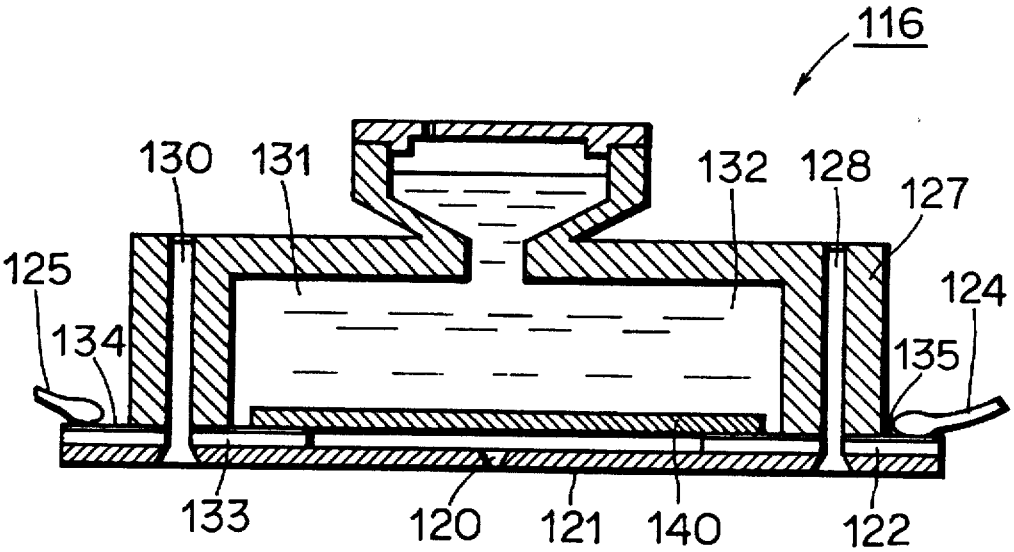
FIG. 15 PRIOR ART
FIG. 15 is a sectional view showing a structure of an ink jet head disclosed in Japanese Patent Laying-Open No. 2-30543.

As shown in FIG. 13, an angle (θ) made by a connecting portion connecting center portion 8a and both ends 8b of ink discharge plate 8 is preferably an obtuse angle in this embodiment. In the case of such an obtuse angle, ink discharge plate 8 is less likely to be reduced in thickness, and less likely to be broken in forming a layer to be formed into ink discharge plate 8 on aluminum layer 15 to provide ink discharge plate 8 in the manufacturing step. Further, stress concentration in the step is alleviated, preventing destruction caused by fatigue.

Center portion 8a may have a length at least one half of the length of ink discharge plate 8 in the longitudinal direction. The longer center portion 8a is, the more preferable. If it is longer, ink discharge plate 8 is always buckled towards nozzle plate 3 stably at a portion of center portion 8a. If it is shorter, there is a possibility that ink discharge plate 8 is buckled at a portion of both ends 8b. It should be noted that both ends 8b are required to control the buckling direction at a portion from the fixed ends to the step of ink discharge plate 8.

Figure 11:
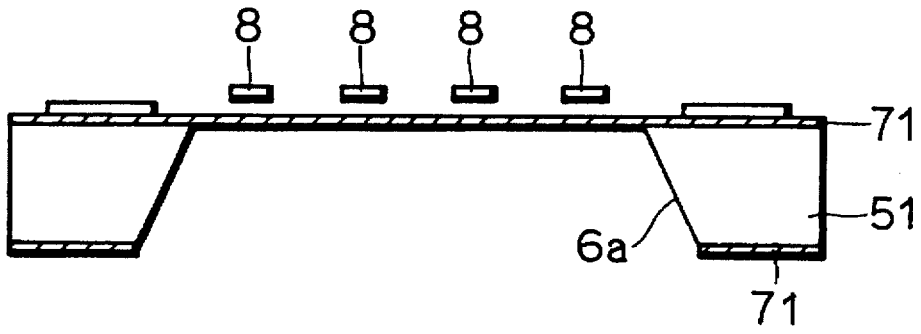

Referring to FIG. 11, PSG layer 71 formed on the rear face of substrate 51 is patterned. With the patterned PSG layer 71 as a mask, substrate 51 is etched with potassium hydroxide (KOH) which is an anisotropic etching solution. By this etching, an opening 6a is formed piercing substrate 51 and having an inclined portion having a sidewall gradually extending from the front face to the rear face of substrate 51. At the same time, aluminum layer 15 is removed.

Figure 12:
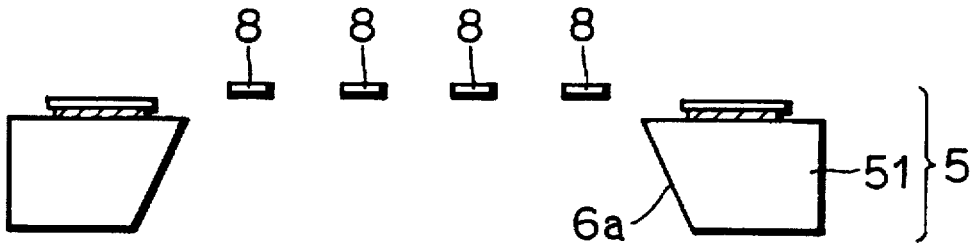

Referring to FIG. 12, by partially removing PSG layer 71 on the front face of substrate 51 together with etching away of PSG layer 71 on the rear face of substrate 51, casing 5 having a desired structure shown in FIG. 1 is complete.

In the ink jet head according to this embodiment, both ends of the ink discharge plate are fixed, and the center portion of the ink discharge plate is arranged closer to the nozzle plate than both ends. As a result, when a compressive force is applied in the axis direction of the ink discharge plate using the compressive member, the bending moment always acts to deform the ink discharge plate towards the nozzle plate because of offset of the axis direction towards the nozzle plate at the center portion. As a result, ink droplets can be reliably discharged, and erroneous operation of the ink jet head can be prevented.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ink jet head applying pressure to an ink liquid filled in an interior thereof for discharging an ink droplet outwards from said interior, comprising:

a nozzle plate having a nozzle orifice;

a vessel having an ink flow path communicating with said nozzle orifice;

a buckling structure body having a center portion positioned between said nozzle orifice of said nozzle plate and said ink flow path, and having opposing ends supported by being sandwiched between said nozzle plate and said vessel, said center portion being closer to said nozzle plate than said opposing ends; and compression means for applying a compressive force in an axis direction of said buckling structure body so that said center portion of said buckling structure body is deformed towards said nozzle orifice by buckling.

2. The ink jet head as recited in claim 1, wherein said compression means is a power source device capable of applying a voltage to said buckling structure body.

3. The ink jet head as recited in claim 1, wherein said buckling structure body is formed of a metal material.

4. The ink jet head as recited in claim 1, wherein said buckling structure body is formed of nickel or titanium.

5. The ink jet head as recited in claim 1, wherein said buckling structure body has a rectangular cross sectional shape.

6. The ink jet head as recited in claim 1, wherein an angle made by a connecting portion connecting said center portion and said opposing ends of said buckling structure body is an obtuse angle.

7. The ink jet head as recited in claim 1, wherein a length of said center portion of said buckling structure body in a longitudinal direction is at least ½ of an entire length of said buckling structure body in the longitudinal direction.

8. The ink jet head as recited in claim 1, wherein said buckling structure body includes bent portions in a vicinity of said opposing ends such that said center portion is closer to said nozzle plate than said opposing ends.

9. The ink jet head as recited in claim 8, wherein said bent portions are step shaped.

* * * * *